US006995527B2

(12) United States Patent
DePasqua

(10) Patent No.: US 6,995,527 B2
(45) Date of Patent: Feb. 7, 2006

(54) POINT-N-CLICK STEERING

(75) Inventor: Louis DePasqua, Round Lake Beach, IL (US)

(73) Assignee: Innovative Technologies Corporation, Round Lake Beach, IL (US)

( * ) Notice: Subject to any disclaimer, the term of this patent is extended or adjusted under 35 U.S.C. 154(b) by 90 days.

(21) Appl. No.: 10/779,330

(22) Filed: Feb. 13, 2004

(65) Prior Publication Data

US 2004/0227484 A1 Nov. 18, 2004

Related U.S. Application Data

(63) Continuation-in-part of application No. 10/438,654, filed on May 15, 2003, now abandoned.

(51) Int. Cl.
*H04Q 7/00* (2006.01)

(52) U.S. Cl. ..... 318/16; 318/581; 318/585

(58) Field of Classification Search ..... 318/16, 318/581, 588, 647, 648, 480, 489; 388/933; 701/21, 116; 440/6

See application file for complete search history.

(56) References Cited

U.S. PATENT DOCUMENTS

| | | | | |
|---|---|---|---|---|
| 4,614,900 | A | 9/1986 | Young | |
| 4,824,408 | A | 4/1989 | Aertker et al. | |
| 5,172,324 | A | 12/1992 | Knight | |
| 5,202,835 | A | 4/1993 | Knight | |
| 5,386,368 | A | 1/1995 | Knight | |
| 5,491,636 | A | 2/1996 | Robertson et al. | |
| 5,523,951 | A | 6/1996 | Kriesgman et al. | |
| 5,606,930 | A | 3/1997 | LeBlanc et al. | |
| 5,832,440 | A | 11/1998 | Woodbridge et al. | |
| 5,859,517 | A | 1/1999 | DePasqua | |
| 5,884,213 | A | 3/1999 | Carlson | |
| 6,678,589 | B2 * | 1/2004 | Robertson et al. | 701/21 |

OTHER PUBLICATIONS

"HMC 1055 Advance Information," Dec. 2002, Honeywell Sensor Products, undated, 12 pages, Solid State Electronics Center.

"Cabela's Marine 2003," 2003, 11 pages, Cabela's Inc., Sidney, Nebraska.

* cited by examiner

*Primary Examiner*—Karen Masih
(74) *Attorney, Agent, or Firm*—Wallenstein Wagner & Rockey, Ltd.

(57) ABSTRACT

The present system is a system for controlling a trolling motor in a fishing boat. The system comprises a transmitting unit and a receiving unit. The transmitting unit includes a direction sensor, a selection switch, and a transmitter. The direction sensor automatically senses the direction to which the user desires to steer the fishing boat when the user points the direction sensor in that direction. The user then uses the selection switch, and by "clicking" the switch once the transmitter sends a signal with the direction information to the receiving unit. The receiving unit then receives the signal containing the direction information, and affects the trolling motor in such a way that it steers the fishing boat in the desired direction.

91 Claims, 6 Drawing Sheets

POINT-N-CLICK STEERING

CROSS-REFERENCE TO RELATED APPLICATIONS

This application is a Continuation-in-Part of and claims the benefit of U.S. Utility patent application Ser. No. 10/438,654, filed May 15, 2003 now abandoned, which is incorporated by reference herein and made a part hereof.

TECHNICAL FIELD

The present invention generally relates to controllers for boat motors, more specifically, the present invention relates to wireless controllers for trolling motors.

BACKGROUND OF THE INVENTION

Trolling motors have been long used by anglers to move fishing boats through the water in search of fish. These motors, which are usually electric, are adapted to move a fishing boat, bass boat, or the like at a speed conducive to the use of trailing lures such as "spinners" or other such lures designed to be pulled through the water. It is essential to accurately control these motors to ensure the safety of the angler as well as to correctly position the lure so as to maximize the angler's take of fish. Previously designed trolling motor controllers allow the user to control the direction to which the motor steers the boat from a location remote from the motor. U.S. Pat. No. 4,614,900 to Young discloses a hand-held or foot-operated controller for controlling an electric trolling motor to change the direction of a boat, by going left or right. In another embodiment of the invention, there is a switch on the controller to turn the motor on or off, in addition to the switch that controls the direction to which the motor steers. Thus, the angler can be anywhere in the boat and simultaneously steer the boat.

U.S. Pat. No. 5,859,517 to DePasqua, the inventor of the present invention, discloses a controller for a trolling motor in a fishing boat. The controller is affixable to a finger or a fishing pole to allow the angler to simultaneously move around the boat and perform various tasks that require a hand or hands. The angler can meanwhile maintain control over the boat. The controller being capable of controlling several functions of the trolling motor, such as turning the motor on and off, controlling the steering position of the motor, and controlling the speed of the motor. The controller also operates wirelessly using radio frequency communication.

Young describes a controller, which either occupies the use of the hand when using the hand-held embodiment, or necessitates the use of the foot when using the foot pedal, which fixes the location of the angler within the boat. DePasqua describes a controller that allows more mobility about the boat, however, using it occupies at least one hand, since switches and buttons are used to operate and control the trolling motor. Therefore, it is apparent that these devices do not provide complete freedom of mobility about the boat, and a total hands-free operation of the controller for the trolling motor.

Additional prior systems include that which is disclosed in U.S. Pat. No. 5,172,324 to Knight, U.S. Pat. No. 5,202,835 to Knight, U.S. Pat. No. 5,884,213 to Carlson, and U.S. Pat. No. 5,491,636 to Robertson et al. The disclosure and teachings of the Knight, Carlson, and Robertson references are expressly incorporated herein by reference. Carlson and Knight describe navigation systems comprising a magnetic compass to determine the heading of the boat and the heading of the motor, respectively. Unfortunately, these compasses do not account for the roll angle and pitch angle of the compass due to the natural motion of the boat in the water. Failing to account for these angles undermines the accuracy of the heading detected by the compass. The present invention is provided to improve upon and solve these and other problems.

SUMMARY OF THE INVENTION

The present invention is a trolling motor controller, which has a sensor that can be pointed in the direction to which the motor is to steer the boat. The sensor senses the desired direction. One click of a button steers the boat in the desired sensed direction.

In one embodiment, the controller is mounted on a fishing pole, along with a SetSteer button. The user simply points the fishing pole in the desired direction, and clicks the SetSteer button. The trolling motor will then automatically steer the boat to the direction to which the user pointed. The steering sensor is an electronic magnetic compass sensor, mounted on the fishing pole. Pointing the fishing pole into the desired direction and clicking the SetSteer button, causes the magnetic compass sensor to transmit a signal wirelessly, using radio frequencies (RF), to the trolling motor receiver, which also has a magnetic compass. The receiver then affects the trolling motor, which in turn steers the boat in the magnetic compass heading, sent by the user.

In another embodiment, the magnetic compass sensor is substituted for a tilt compensated digital compass. The tilt compensated digital compass adjusts the heading detected by a digital compass to account for the pitch angle and the roll angle experienced by the digital compass. When a magnetic compass is mounted on a trolling motor receiver, pitch and roll angles are induced by the natural motion of the boat in the water. Moreover, when a magnetic compass is mounted on the fishing pole, pitch and roll angles are induced by the natural motion of the boat in the water and the natural motion of the fisherman's hand as the fisherman points the fishing pole in the desired direction of travel. By compensating for pitch and roll angles, the tilt compensation device improves the accuracy of the reading from the magnetic compasses.

In another embodiment, the steering sensor is an infrared or laser light, mounted on the fishing pole. When the user clicks the SetSteer button, a light beam is transmitted to the trolling motor receiver, which has a photo detector circuit capable of detecting the angle of the steering direction sensor. The trolling motor is then pointed into that direction, and the boat is then steered into that same direction.

In another embodiment, the steering sensor is a radio waves phase direction detector. When the user clicks the SetSteer button, a radio wave signal is transmitted through the air from the fishing pole. The trolling motor receiver then calculates a delay time based upon two transmitted signals to determine the direction to which the sensor is pointed, and the boat is then steered into that same direction.

In other embodiments, the steering sensor can be mounted on a hat or a pair of glasses that the user may be wearing. In such embodiments the user points their face in the direction they would like the boat to go and click the SetSteer button.

In another embodiment, a tilt compensated digital compass for detecting the heading of a trolling motor is mounted on the trolling motor located at the front of the boat. Tilt compensation accounts for the natural motion of trolling motor in the water. Using an input device, such as the point and click steering method described above, a feedback analyzer instructs a controller to direct the trolling motor to acquire and maintain a desired target heading. The heading of the trolling motor is then oriented toward the desired target heading. The boat then acquires the desired target heading because the trolling motor is pulling the boat through the water.

In another embodiment, a tilt compensated digital compass is located at the front of the boat for detecting the heading of the boat. In addition, the boat is equipped with global positioning satellite technology to determine the actual position of the boat and the position of user-inputted waypoints. A control circuit uses the information provided by the tilt compensated digital compass and the global positioning satellite technology to control the thrust and steering of the boat's trolling motor. The boat will then travel from its present position along a path comprised of the user-inputted waypoints.

Other features and advantages of the invention will be apparent from the following specification taken in conjunction with the following drawings.

DETAILED DESCRIPTION

Figure 1:
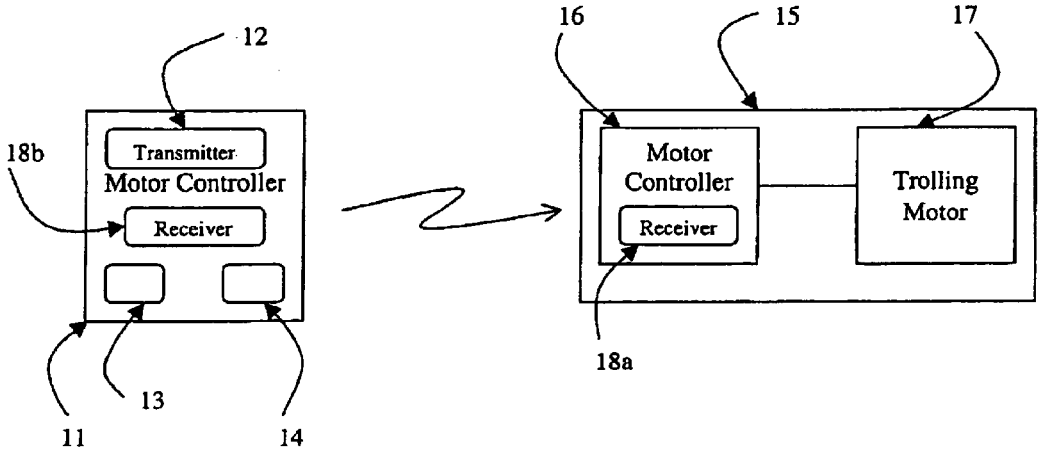
FIG. 1 is a block diagram of the trolling motor controller system.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is generally directed to a system and a method for controlling a trolling motor to a direction sensed by a sensor pointed in the target direction to which the motor is to steer the boat. One click of a button steers the boat in the desired sensed direction. The controller can be used by an angler to control the steering of a fishing boat through water, and at the same time be able to carry on other activities that require both hands. An important feature of this system is that it allows the angler to be anywhere in the boat, and not be restricted to one area to steer through the water.

FIG. 1 is a block diagram of the trolling motor controller system. The system comprises transmitting unit 11, and receiving unit 16. The transmitting unit 11 comprises a RF transmitter 12, a RF receiver 18*b*, a direction sensor 13, and a selection switch 14. The direction sensor 13 senses the target direction set by the user 19, which is done by pointing the sensor in the desired direction. The user 19, then "clicks" the selection switch 14, which triggers the RF transmitter 12 to transmit a RF signal that contains the information regarding the desired direction to which to steer a boat 20. The signal is then received by the receiving unit 16, which comprises a receiver 18*a*. The receiving unit 16 is connected to the trolling motor 17. When the receiver 18*a* receives the signal sent by the transmitter 12, the receiving means 16 affects the trolling motor 17 to steer the boat 20 in the desired direction. It should be understood that the preceding description for transmitting the target direction from the transmitting unit 11 to the receiving unit 16 is not limiting, and other embodiments fall within the scope of the present invention. In another embodiment, the transmitting unit 11 can transmit the target direction to the receiving unit 16 using a wired or wireless connection. In another embodiment, the selection switch 14, using a wired or wireless connection, can trigger the transmitting unit 11 to transmit the target direction. In yet another embodiment, the selection switch 14 could, wired or wirelessly, transmit a first request to the receiving unit 16 to send a second request to the transmitting unit 11 for the target direction. Additionally, the signals transmitted by the transmitting unit 11, the receiving unit 16, and the selection switch 14 can be either a digital signal or an analog signal. Further, it is worth noting that the transmitting unit 11 need not be in one encasement. It is possible to have the direction sensor 13 in a different location from the selection switch 14. This will be explored in more detail in descriptions of different embodiments of the system. It is also worth noting that "click" does not restrict the action to the physical act of clicking a switch. The selection switch 14 can be such that it requires an actual clicking by a finger, or pressing on by a foot, it also can be "clicked" or activated by the angler's voice or some other sound. The methods of "clicking" of the selection switch 14 discussed here do not limit the invention or the method by which the selection switch 14 can be activated.

Figure 2:
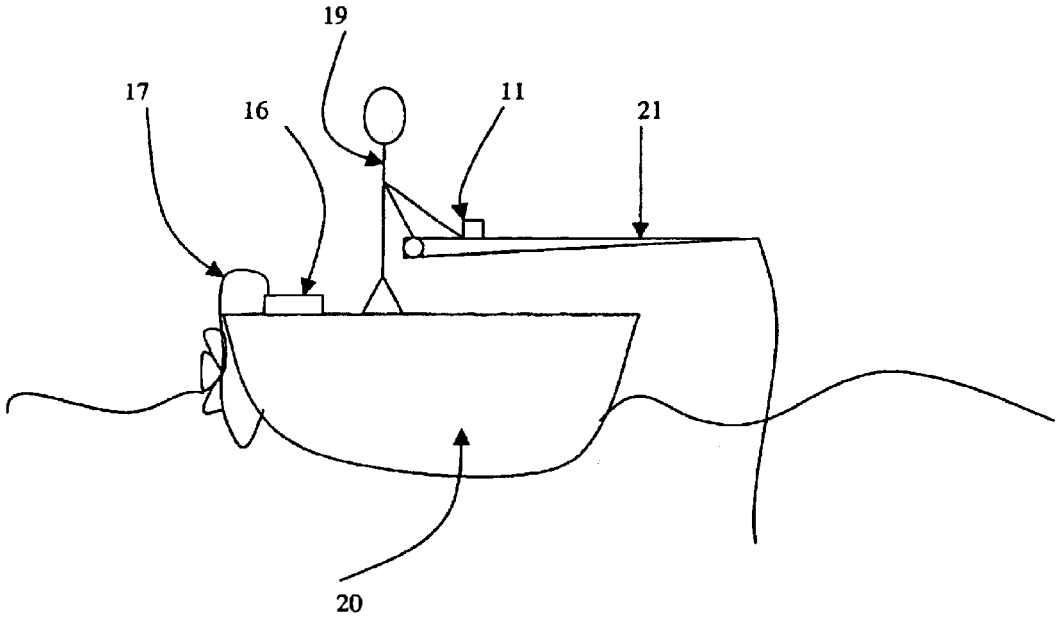
FIG. 2 is a diagram of an embodiment of the system.

One embodiment of the trolling motor controller system is illustrated in FIG. 2. In this embodiment the angler 19, is fishing while steering a fishing boat 20. The fishing boat 20 is being steered by a trolling motor 17, which is controlled by the a trolling motor controller receiving unit 16, which controls the trolling motor 17 in response to a signal received from the trolling motor controller transmitting unit 11. In this embodiment the transmitting unit 11 is mounted on the fishing pole 21. When the angler 19 desires to change the steering direction of the fishing boat 20, he points the fishing pole 21 in the desired direction. The direction sensor 13 then senses the direction at which the fishing pole 21 is pointed, and when the angler 19 "clicks" the selection switch 14 once, the transmitter 12 of the transmitting unit 11 to produce a RF signal which carries information regarding the desired direction sensed, and transmits it to the receiving unit 16.

Figure 3:
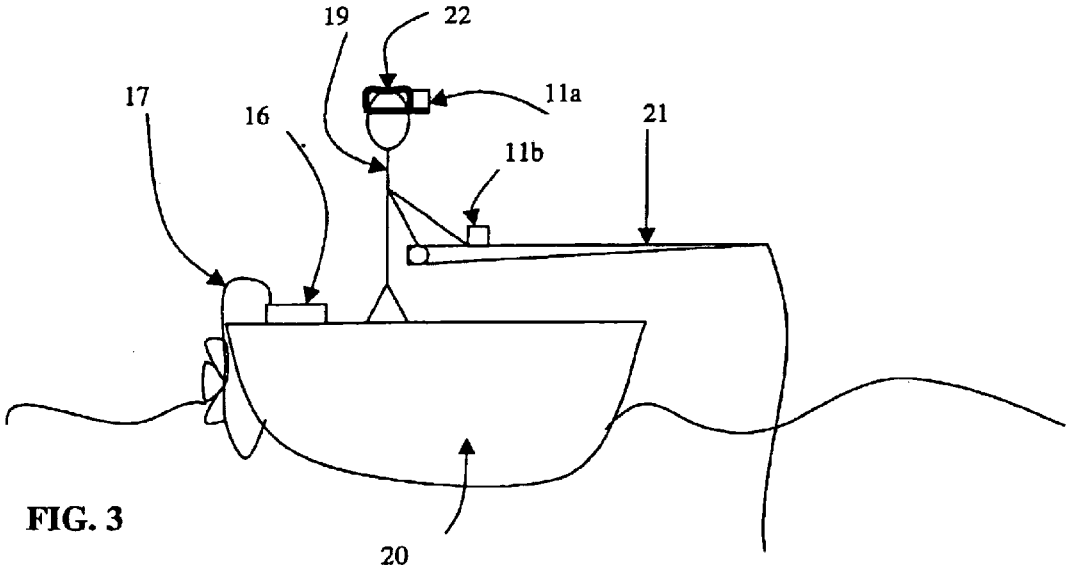
FIG. 3 is a diagram of another embodiment of the system.

Another embodiment of the trolling motor controller system is illustrated in FIG. 3. In this embodiment the angler 19 has a hat 22 on and part of or the entire transmitting unit 11 can be mounted onto the hat 22. In one embodiment, part of the transmitting unit, 11*a*, is mounted on the hat 22, and the other part, 11*b*, is on the fishing pole 21 or somewhere easily accessible by the angler 19, such as the side of the boat. In this case, the angler 19 turns his head in the direction to which he desires to steer the fishing boat, the angler 19 "clicks" the selection switch 14, also part of 11*b*, which transmits a "click" active signal to receiver 18*b*, as a result activating sensor 13 that is part of the transmitting unit 11*a*. The sensor 13 automatically senses the desired direction and sends the sensed direction to the receiving unit 16, which in turn affects the trolling motor 17 appropriately to steer in the desired direction. In another embodiment the entire transmitting unit 11 is mounted on the hat 22, and just as in the previously described embodiment, when the angler 19 turns his head in the direction to which he desires to steer the fishing boat, the sensor 13 automatically senses the desired direction. When the angler 19 "clicks" the selection switch 14, the sensed direction is transmitted to the receiving unit 16, which in turn affects the trolling motor 17 appropriately to steer the fishing boat 20 in the desired direction. In the case where the transmitting unit 11 is separated into two sections 11*a* and 11*b*, the choice for the location of 11*b* depends on the method chosen for "clicking" the selection switch 14 or as desired by the angler 19.

Figure 4:
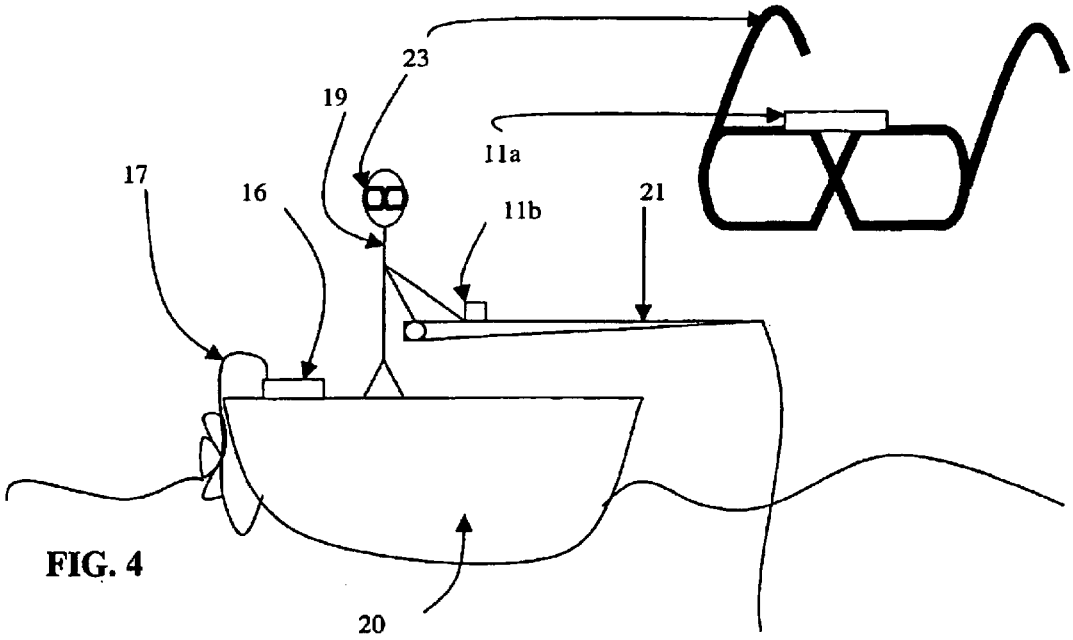
FIG. 4 is a diagram of another embodiment of the system.

Another embodiment of the system is illustrated in FIG. 4. In this embodiment the angler 19 has a pair of glasses 23 on and part of or the entire transmitting unit 11 can be mounted onto the pair of glasses 23. In one embodiment, part of the transmitting unit, 11*a*, is mounted on the pair of glasses 23, and the other part, 11*b*, is on the fishing pole 21 or somewhere easily accessible by the angler 19. In this case, the angler 19 turns his head in the direction to which he desires to steer the fishing boat, "clicks" the selection switch 14, also part of 11*b*, which transmits a "click" active signal to receiver 18*b*, as a result activating sensor 13 that is part of the transmitting unit 11*a*. The sensor 13 automatically senses the desired direction and sends the sensed direction to the receiving unit 16, which in turn affects the trolling motor 17 appropriately to steer in the desired direction. In another embodiment the entire transmitting unit 11 is mounted on the pair of glasses 23, and just as in the previously described embodiment, when the angler 19 turns his head in the direction to which he desires to steer the fishing boat, the sensor 13 automatically senses the desired direction. When the angler 19 "clicks" the selection switch 14, the sensed direction is transmitted to the receiving unit 16, which in turn affects the trolling motor 17 appropriately to steer the fishing boat 20 in the desired direction. In the case where the transmitting unit 11 is separated into two sections 11*a* and 11*b*, the choice for the location of 11*b* depends on the method chosen for "clicking" the selection switch 14 or as desired by the angler 19.

There are several choices for the direction sensor 13. In one embodiment the direction sensor 13 can be an electronic magnetic compass mounted on the fishing pole 21, the hat 22, or the glasses 23. The magnetic compass sensor heading is transmitted via the transmitter 12, when the selection switch 14 is "clicked," to the receiving unit 16, which also has a magnetic compass. The receiving unit 16 then affects the trolling motor 17 to steer the fishing boat into the magnetic compass heading selected by the user.

In another embodiment, the direction sensor 13 is a tilt compensated digital compass mounted on the fishing pole 21, the hat 22, or the glasses 23. Tilt compensation is necessary because a compass typically provides an erroneous heading when it experiences a roll angle, a pitch angle, or both. These roll and pitch angles should be expected in the applications described in the preceding and antecedent embodiments given the natural movements of the human hand or head and the inherent movement related to the operation of a boat in water. In another embodiment, the tilt compensated digital compass may comprise a three axis solid state magnetic sensor. A three axis solid state magnetic sensor is an electromagnetic compass where the sensors have three four-element wheatstone bridge sensors for detecting the earth's magnetic fields. A tilt compensated digital compass such as the one described herein may be purchased off the shelf. For example, Honeywell produces a 3-Axis Compass Sensor Set, Part No. HMC1055, that is compatible with the present application. A detailed schematic and description of Honeywell's HMC1055 can be found on the Internet at: http://www.ssec.honeywell.com/magnetic/datasheets/hmc1055.pdf. The information and teachings contained at this location on the Internet are incorporated herein by reference.

In another embodiment, a digital compass without tilt compensation is used and the heading is then adjusted by a tilt compensator. The tilt compensator measures the roll and pitch angles. The measurement of the roll and pitch angles could be performed by, but is not limited to, a solid state magnetic sensor, an electronic sensor or a fluid tilt sensor. The tilt compensator also adjusts the heading of the digital compass to account for the roll and pitch angles. The adjustment could be performed by, but is not limited to, a microprocessor, a circuit, or other devices that have the ability to compute specified mathematical algorithms. After determining the tilt compensated heading, the heading is then transmitted via the transmitter 12, when the selection switch 14 is "clicked," to the receiving unit 16, which also has a compass. The receiving unit 16 then affects the trolling motor 17 to steer the fishing boat into the magnetic compass heading selected by the user.

In another embodiment the direction sensor 13 is an infrared or laser light mounted on the fishing pole 21, the hat 22, or the glasses 23. When the user 19 "clicks" the selection switch 14, a light beam is transmitted by the transmitting unit 11 to the receiving unit 16, which in this embodiment has a photo detector circuit capable of detecting the angle of the direction sensed by the direction sensor 13. The receiving unit 16 then affects the trolling motor 17 to steer the boat 20 in the desired direction.

In yet another embodiment the direction sensor 13 is a radio waves phase direction detector mounted on the fishing pole 21, the hat 22, or the glasses 23. When the user 19 "clicks" the selection switch 14, radio signals are transmitted through the air from the transmitting unit 11, which is mounted on the fishing pole 21, the hat 22, or the glasses 23. The receiving unit 16 then receives the signal and calculates a delay time based on two transmitted signals to determine the direction the direction sensor 13 is pointed. The receiving unit 16 then affects the trolling motor 17 to steer the fishing boat 20 in the desired direction.

Figure 5:
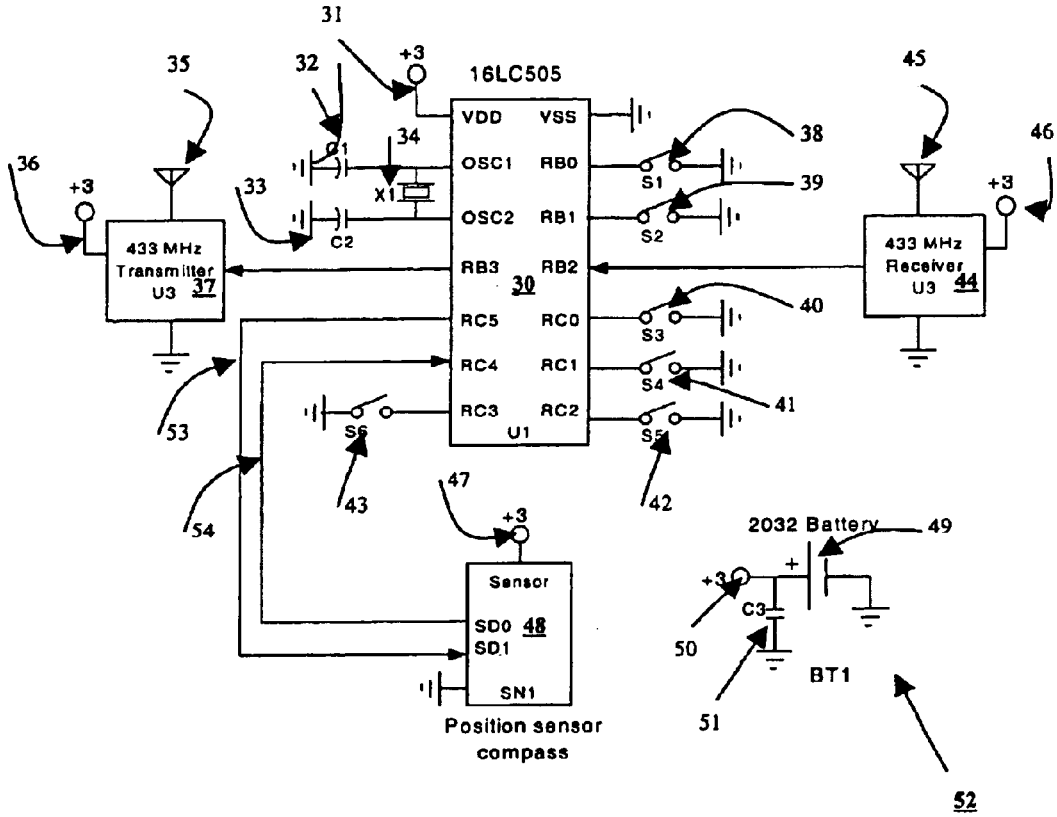
FIG. 5 is a schematic of the controller transmitter.

FIG. 5 is a schematic of one embodiment of the circuit of the controller transmitter unit 11. A 3-Volt lithium battery 52 powers the transmitter circuit; capacitor 51 is used for a bypass filter to reduce the noise generated by the circuitry. The processor 30 contains the firmware that provides the proprietary operation for the transmitter. The crystal 34, and the capacitors 32 and 33 provide the system clock. The receiver 44 operates at 433 MHz, and receives signal through its antenna 45, and is powered by a 3-Volt battery 46. The purpose of the receiver 44 is to allow the transmitter to be controlled by an external device, i.e. when the selection switch 14 is "clicked" through an external source such as a fishing pole controller 11*b*, or some other source of activation, the transmitter's receiver 44 receives a signal to indicate the selection switch 14 has been "clicked." The selection switch 14 is associated with switch 38 in the transmitter circuit. Switches 39–43 are used to control the operation of the trolling motor 17, such as turning the motor on and off, speeding up or down, and steering left or right. When any of the switches 39–43 is pressed, the processor 30 will send a data command through the airwaves via the transmitter 37, which is powered by a 3 Volt battery 36, and utilizing the antenna 35, to the receiving unit 16, to affect the trolling motor 17. When the user wishes to change the direction of steering of the boat 20, he will point the direction sensor 13 in the desired target direction, by either pointing the fishing pole or his head, and activate the heading by "pressing" switch 38 either directly as in the embodiment shown in FIG. 2, or by sending a command via another RF device, as in the embodiments shown in FIG. 3 and FIG. 4. When the processor 30 receives the command, it will request the position from the position sensor (the type of sensor will depend on the embodiment employed) 48 through ports 53 and 54. The processor 30 will then transmit the heading via the transmitter 37, which operates at 433 MHz, to the receiving unit 16, which will load the compass position and affect the trolling motor 17 to steer the boat 20 in that direction.

Figure 6:
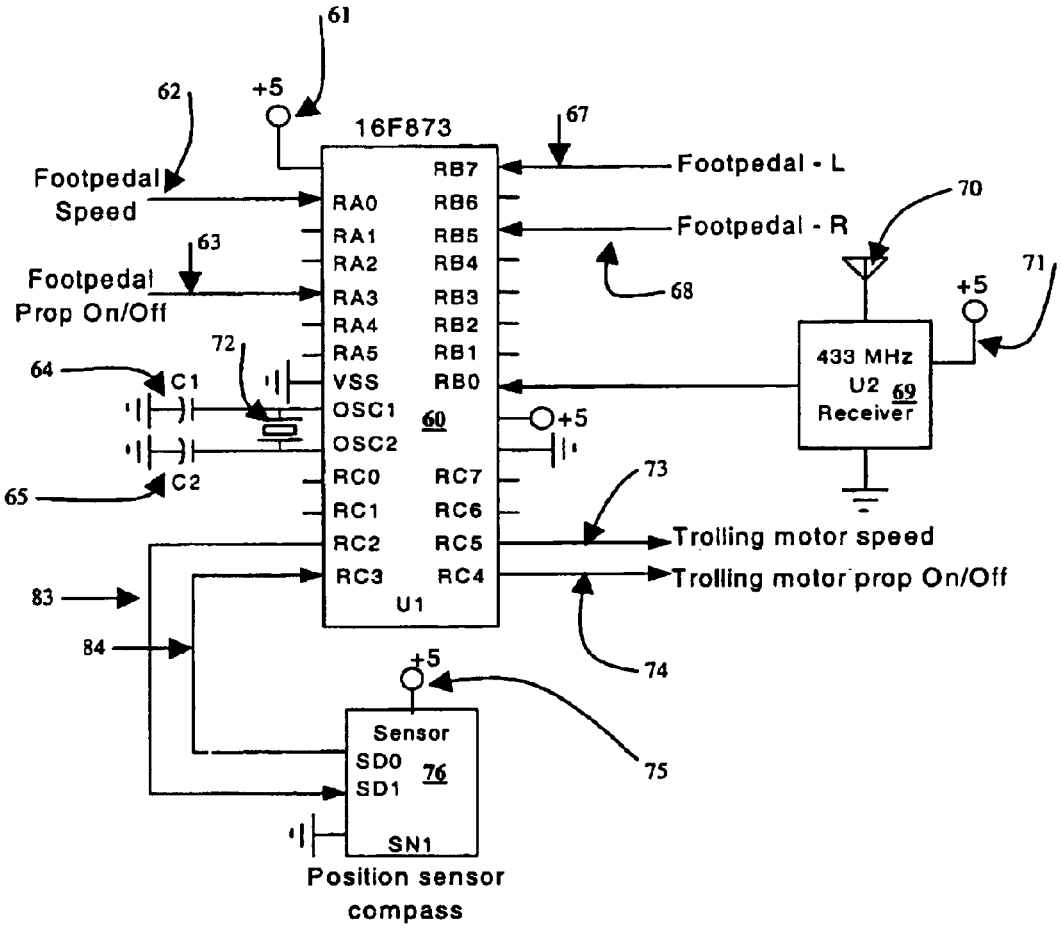
FIG. 6 is a schematic of the controller receiver.
Figure 6:
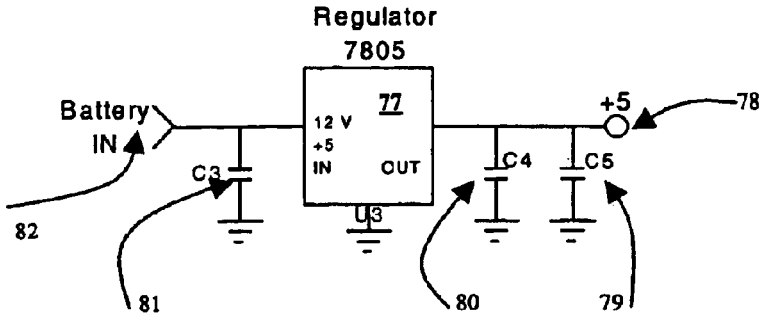

FIG. 6 is a schematic of one embodiment of the circuitry of the controller receiver unit 16. The receiving unit 16 is plugged directly between the trolling motor 17 and the foot pedal. This setup allows for control of the trolling motor 17 without modifying the existing setup. The receiving unit 16 has a supply voltage that is powered by the trolling motor power supply and regulated by a regulator 77. The power supply from the trolling motor 17 is input into the regulator at point 82, and is then filtered by the filtering capacitors 79, 80 and 81, to produce an output of 5 Volts at point 79, which supplies the receiving unit 16 with 5 Volts. The existing foot pedal is still functional via scanning inputs on the processor 60. The speed control associated with the foot pedal is loaded into the A to D converter at input 62, and processed as necessary by the processor 60. The processor 60 through inputs 63, 67 and 68 also reads the propeller and steering switches in the foot pedal. The software running on the processor 60 will automatically determine the operation of the foot pedal in relation to the data received by the transmitter. When the processor 60 receives data via the receiver 69, operating at 433 MHz, through the antenna 70, the software decodes the information and determines the appropriate response. When a position is transmitted, the receiving unit 16 will then process the information and steer the boat into the direction sent by the transmitting unit 11. If the position sensor 76 is mounted into the trolling motor's head, the receiver software will then turn the trolling motor head into the direction of the desired position until the matching position is found, then it will stop steering. If the position sensor 76 is located in the receiving unit 16 itself the trolling motor 17 will then steer the boat itself into the desired direction until the matching position is located and then it will stop steering. If the trolling motor steering motor is a digital proportional position feedback style motor, the direction of the motor head can be positioned by calculating the angle difference between the transmitter position sensor 48 and the receiver position sensor 76. The processor 60 communicates with the position sensor 76 via the ports 83 and 84.

Figure 7:
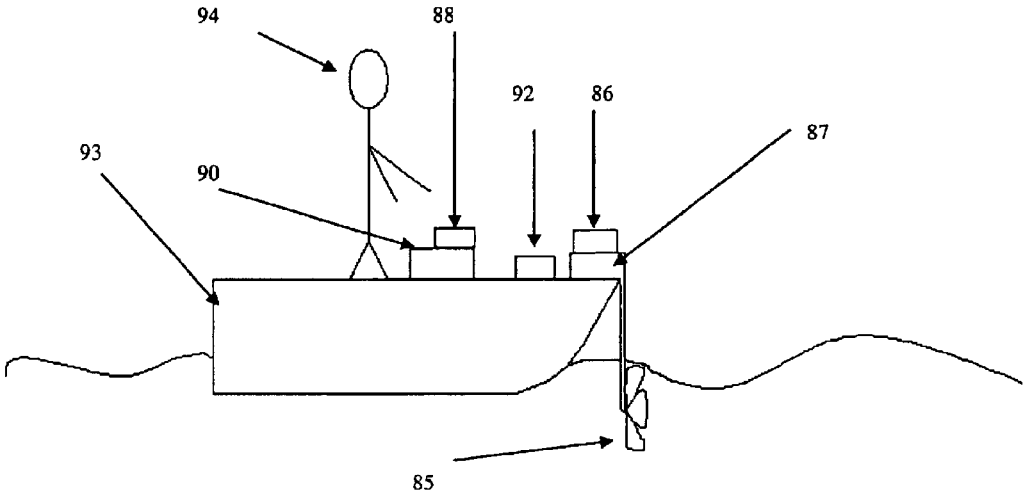
FIG. 7 is a diagram of another embodiment of the system.
Figure 8:
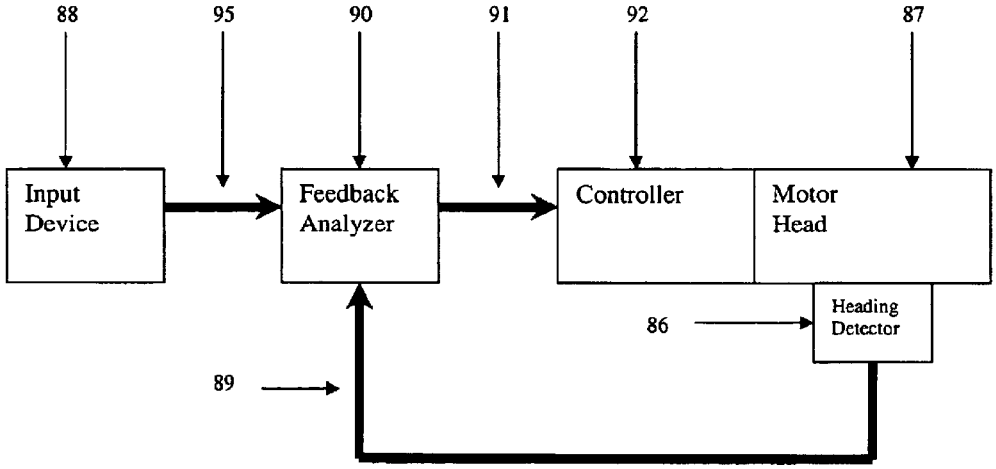
FIG. 8 is a block diagram of another embodiment of the system.

Another embodiment of a motor control system is illustrated in FIG. 7 and FIG. 8. In this embodiment, a propulsion device 85 is attached on the front of a boat 93 so as to pull the boat 93 in the direction of the thrust produced by the trolling motor 85. The propulsion device 85 may be, but is not limited to, an electric trolling motor or a device with either a rotating propeller or an rotating impeller. Further, the propulsion device 85 could be attached to other parts of the boat 93 such as the rear of the boat 93. A heading detector 86 is affixed to the trolling motor head 87 such that it can detect the heading of the trolling motor. The heading detector 86 is comprised of a tilt compensated digital compass, such as the Honeywell HMC1055 described above. Alternatively, the tilt compensated digital compass can be embodied in the manner described above.

In a preferred embodiment, the user 94 transmits a desired heading to the input device 88. The input device 88 generates a target heading signal 95 that is representative of the desired heading. The input device 88 could be of at least one of a point and click steering system using an input device mounted on a fishing pole, hat, or glasses, as described above; a keypad for inputting the desired heading; a device employing voice recognition software for inputting the desired heading; a foot pedal having a variable angular position wherein the angular position is indicative of the desired heading; a hand lever; and other types of embodiments.

The heading detector 86 then detects the tilt compensated heading of the trolling motor head 87. Tilt compensation of the digital compass is necessary to account for the error that the natural motion of the boat in the water can induce in an uncompensated compass. The tilt compensated heading is sent as a feedback signal 89 to a feedback analyzer 90.

Utilizing the feedback signal 89, the feedback analyzer 90 compares the target heading signal 95 to the feedback signal 89. The feedback analyzer 90 could be of at least one of a digital circuit, an analog circuit, a microprocessor, a processor, and other embodiments that can perform the comparisons and calculations to account for the feedback signal 89 with respect to the target heading signal 95. Based on this comparison, the feedback analyzer 90 sends a control signal 91 to a controller 92 connected to the trolling motor head 87. The controller 92 may be located either within the trolling motor head 87 or remotely from the trolling motor head 87. The controller 92 instructs the trolling motor 85 to achieve a heading that is substantially identical to the heading represented by the target heading signal 95.

In another embodiment, the feedback analyzer 90 can periodically sample the heading detector 86 to ensure that the tilt compensated heading of the trolling motor head 87 remains substantially identical to the heading represented by the target desired heading signal 95. If the tilt compensated heading of the trolling motor head 87 is not substantially identical to the heading represented by the target heading signal 95, the feedback analyzer 90 will send a new control signal 91 to the controller 92 such that the controller 92 will affect a heading of the trolling motor 85 that is substantially identical to the heading represented by the target heading signal 95. Because a boat 93 being pulled through the water by a trolling motor 85 will achieve the heading of the thrust produced by the trolling motor 85, the boat 93 will eventually achieve a heading that is substantially identical to the heading represented by the target heading signal 95. It is worth noting that transmission of signals between the input device 88 and the feedback analyzer 90, between the feedback analyzer 90 and the controller 92, the controller 92 and the propulsion device 87, and between the heading detector 86 and the feedback analyzer 90 can be either wired or wireless. It is also worth noting that the foregoing signals can be either digital or analog signals.

Figure 9:
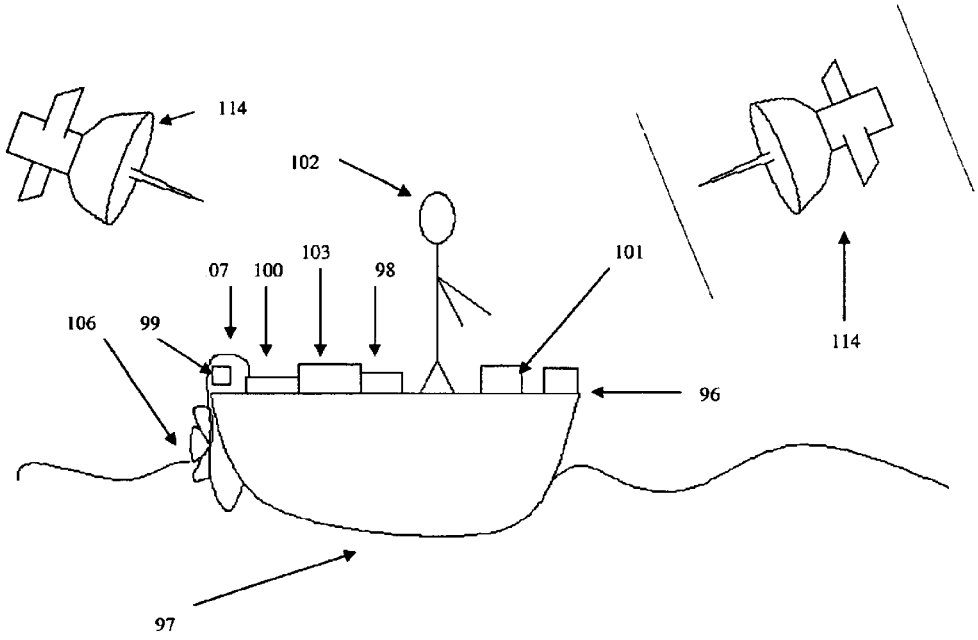
FIG. 9 is a diagram of another embodiment of the system.
Figure 10:
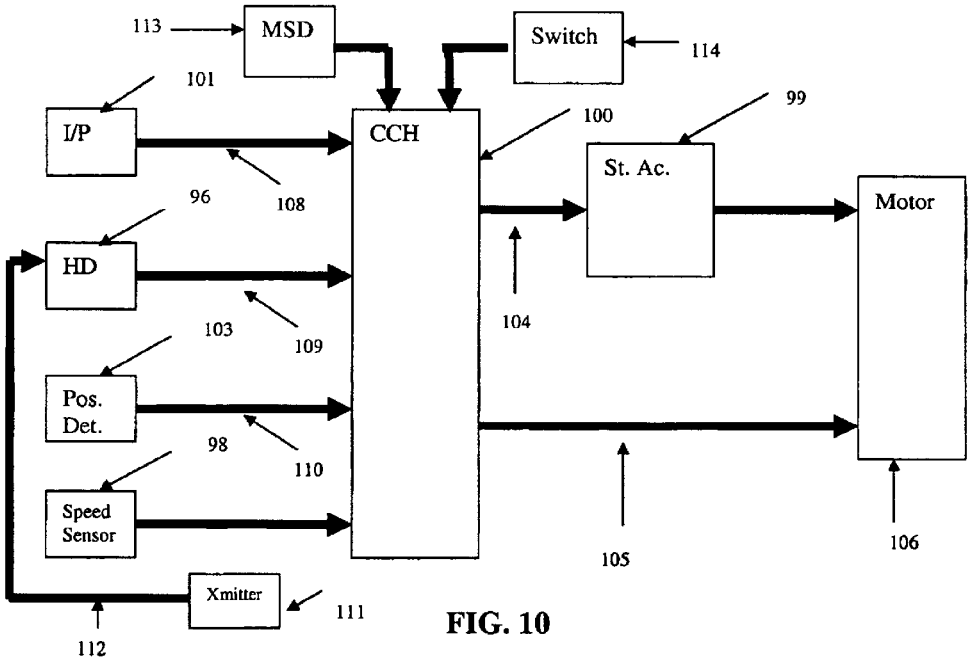
FIG. 10 is a block diagram of another embodiment of the system.

Another embodiment of the motor control system is illustrated in FIG. 9 and FIG. 10. In this embodiment, a heading detector 96, is affixed to the bow of the boat 97. The heading detector 96, is comprised of a tilt compensated digital compass, such as the Honeywell HMC1055 that is described above. Alternatively, the tilt compensated digital compass can be embodied in the manner described above. As previously described, tilt compensation is necessary to account for the roll and pitch angles experienced by the digital compass due to the boat's 97 motion in the water. The heading detector 96 may comprise of at least one of a circuit that determines the actual heading of the boat 97 based upon a change in the actual position of the boat 97 or other embodiments.

Further, the boat 97 is equipped with a speed sensor 98 for determining the speed of the boat 97, a steering actuator 99, control circuit 100 and an input device 101. The steering actuator 99, control circuit 100, and the position detector 103 can be located either within or external to the housing 107 of the propulsion device 106. Additionally, the input device 101 can be mounted on the surface of the housing 107. Also, the speed sensor 98 can determine the absolute speed of the boat 97, wherein the absolute speed is the derivative of at least one of two position signals and the boat's 97 speed relative to the water. The input device 101 can be of at least one of an interface to input the speed at which the user 102 desires to travel; an interface to input waypoints, positions the user 102 desires to travel to; and other embodiments. After the user 102 inputs the desired waypoint, the input device 101 generates a waypoint signal 108 representative of the desired waypoint. The input device 101 can be embodied in, but is not necessarily limited to, a switch, a keypad or voice recognition software. The waypoints received at the input device 101, can, but need not, be designated by a longitudinal value and a latitudinal value.

In a another preferred embodiment, the control circuit 100 determines the actual position of the boat 97 using the position detector 103, the heading of the boat 97 using the heading detector 96, and the position of the first waypoint. The position detector 103 generates a position signal 110 representative of the actual position of the boat 97 which is transmitted to the control circuit 100. The position detector 103 may be comprised of at least one of a global positioning satellite receiver, a differential global positioning satellite receiver, and other embodiments. The position detector 103 can receive signals from a transmitting device 111 or at least two satellites 114. The heading detector 96 generates a heading signal 109 representative of the actual heading of the boat which is transmitted to the control circuit 100. Further, the heading signal 109 can be related to, but is not limited to, the direction of the thrust produced by the propulsion device 106, wherein the propulsion device 106 can be embodied in a variety of different structures as described above; or the orientation of the boat 97. The control circuit 100 determines the heading and the speed the boat 97 must travel in order to reach the waypoint.

The control circuit 100 sends a thrust control signal 105 to the motor 106 to affect a change in the speed of the boat 97 and sends a steering signal 104 to the steering actuator 99 to affect the direction the boat 97 in order for the boat to travel to the desired waypoint. It is worth noting that the control circuit 100 can, but need not, be comprised of a memory device. In the memory device, the control circuit 100 can store one or more waypoints. Also, the steering actuator can be comprised of, but is not limited to, a steering motor; and the magnitude of the thrust produced by the propulsion device 106 may be variable in response to the thrust control signal 105.

In a further embodiment, the control circuit 100 may allow the user 102 to enable an automatic waypoint storage switch 114. Enabling the automatic waypoint storage switch 114 would trigger the storage of the actual position of the boat 97 as a waypoint upon a number of events. These events include, but are not limited to, when a turn is detected, at predetermined distance intervals, or at variable time intervals, wherein the time intervals depend on the rate of change in the heading signal. Other embodiments may include, but are not necessarily limited to, other variations in the control circuit 100 that direct the boat 97 to steer in a predetermined pattern when the boat 97 arrives at a waypoint; steer back to a desired course when the boat 97 deviates from the desired course; steer and generate a thrust control signal 105 to maintain the boat 97 near the desired waypoint when the boat 97 arrives at the desired waypoint; generate a thrust control signal 105 representative of the distance between the boat and the next waypoint; generate a thrust control signal based upon the rate at which the boat 97 is turning; and generate a thrust control signal to turn off the propulsion device 106 when the boat 97 arrives at the desired waypoint.

In another embodiment, the user 102 may create desired paths comprised of several waypoints along which the boat 97 will travel. In yet another embodiment, the motor control system comprises a mode select device 113, wherein the mode select device 113, in at least one of its functions, can allow the user 102 to choose whether to travel along a navigation route comprised of successive waypoints; whether travel along the navigation route in reverse order; whether to travel along the navigation route to the end of the navigation route and then repeat the navigation route in reverse order; or whether steer the boat in a continuous loop around the navigation route, repeating the navigation route in the same order. It is worth noting that the connections between the plurality of devices described in the previous embodiments can be either wired or wireless.

While the specific embodiments have been illustrated and described, numerous modifications come to mind without significantly departing from the spirit of the invention and the scope of protection is only limited by the scope of the accompanying claims.

I claim:

1. A trolling motor controller for controlling a trolling motor and for determining a target heading direction of a boat to which the trolling motor may be connected and directing the boat in the target heading direction, the trolling motor controller comprising:

a transmitting means for transmitting signals, wherein the signals contain information corresponding to the target heading direction for directing the trolling motor controller, the target heading direction being automatically sensed by a direction sensor; and, a receiving means for receiving the signals wherein the receiving means is further operative to cause a change in the steering direction of the trolling motor to achieve the target heading direction.

2. The controller of claim 1, wherein the transmitting means further comprises a direction sensor for automatically sensing the target direction.

3. The controller of claim 2, wherein the direction sensor comprises an electronic magnetic compass.

4. The controller of claim 2, wherein the direction sensor comprises a light source.

5. The controller of claim 2, wherein the direction sensor comprises a radio wave phase direction detector.

6. The controller of claim 1, wherein the transmitting means further comprises a direction set switch for indicating to the receiving means the desire to achieve the target direction when the direction set switch it toggled.

7. The controller of claim 6, wherein achieving the target direction is performed by a single action by an operator.

8. The controller of claim 6, wherein the direction set switch is adapted to be affixable to a member wherein the member allows an operator of the transmitting means to simultaneously affect toggling of the set switch and perform a plurality of operations requiring the operator's hands.

9. The controller of claim 1 further comprising:

a second transmitting means having a direction set switch for indicating to the receiving means the desire to achieve the target direction when the direction set switch is toggled.

10. The controller of claim 1 further comprising:

a second transmitting means having a direction set switch for indicating to the first transmitting means the desire to achieve the target direction when the direction set switch is toggled, the first transmitting means indicating to the receiving means the desire to achieve the target direction when the direction set switch is toggled.

11. A method for controlling a trolling motor and for determining a target heading direction of a boat to which the trolling motor may be connected and directing the boat in the target heading direction, wherein the trolling motor is associated with a trolling motor controller, and wherein the trolling motor controller comprises a transmitting means and a receiving means, the method comprising the steps of:

affecting the sensing of the target heading direction using the transmitting means; and, affecting a change in the trolling motor using the sensed target heading direction to achieve the target heading direction.

12. The method of claim 11 wherein the sensing is performed by a direction sensor.

13. The method of claim 11 wherein a direction sensor indicates the target direction to be achieved.

14. The method of claim 11 further comprising the step of affixing the transmitting means to a member.

15. The method of claim 11 further comprising the step of toggling a direction set switch for indicating to the receiving means the desire to achieve the target direction.

16. The method of claim 11 further comprising the step of operating the transmitting means by a single action by an operator.

17. The method of claim 11 further comprising the step of affixing the transmitting means to a fishing pole.

18. The method of claim 11 further comprising the step of affixing the transmitting means to a hat.

19. The method of claim 11 further comprising the step of affixing the transmitting means to a pair of glasses.

20. The method of claim 15 wherein the direction switch is affixable to a member for allowing an operator of the transmitting means to simultaneously toggle the direction set switch and perform a plurality of operations requiring the operator's hands.

21. The method of claim 15 further comprising the step of toggling the direction set switch for producing a signal.

22. The method of claim 11 further comprising the step of the receiving means receiving a signal from the transmitting means.

23. The method of claim 11 further comprising the step of the receiving means producing a signal.

24. The method of claim 11 further comprising the step of the receiving means affecting a change in the trolling motor.

25. A trolling motor control system for controlling a trolling motor and for determining a target heading direction of a boat to which the trolling motor may be connected and directing the boat in the target heading direction, the trolling motor system comprising:

a direction sensor for sensing the target heading direction, a signal comprising information corresponding to the target heading direction for the trolling motor controller to achieve, wherein the signal is used to cause a change in the steering direction of the trolling motor to achieve the target heading direction.

26. The trolling motor control system of claim 25, further comprising:

a transmitter for transmitting the signal; and, a receiver for receiving the signal.

27. The trolling motor control system of claim 25, wherein the direction sensor comprises a three-axis tilt compensated compass.

28. The trolling motor control system of claim 26, wherein the three-axis tilt compensated compass comprises at least one of a fluid tilt sensor and an electronic tilt sensor.

29. The trolling motor control system of claim 26, wherein the receiver is connected to a circuit capable of determining the target direction from the signal.

30. The trolling motor control system of claim 26, wherein the transmitter is operably connected to a direction set switch for indicating when to acquire the target direction.

31. The trolling motor control system of claim 30, wherein the direction set switch is adapted to be affixable to a member, wherein the member allows an operator of the transmitter to simultaneously affect toggling of the direction set switch and perform a plurality of operations requiring the operator's hands.

32. The trolling motor control system of claim 26 further comprising:

a direction set switch, remotely located from the transmitter, for transmitting signals to the receiver to acquire the target direction when the direction set switch is toggled.

33. The trolling motor control system of claim 26, further comprising:

a second receiver, operatively connected to the transmitter, for receiving a request for the target direction; and, a second transmitter, operatively connected to the receiver, for transmitting signals requesting the target direction.

34. A method for controlling a trolling motor and for changing a target heading direction of a boat to which the trolling motor may be connected and directing the boat in the target heading direction, wherein the trolling motor is operatively connected to a trolling motor controller, and wherein the trolling motor controller comprises a transmitter, the method comprising the steps of:

affecting the sensing of the target heading direction using the transmitter; and, affecting a change in the trolling motor using the sensed target heading direction to achieve the target heading direction.

35. The method of claim 34 further comprising the step of toggling a direction set switch for indicating that the target direction should be acquired.

36. The method of claim 34, wherein the step of affecting a change in the trolling motor direction is performed by a single action by an operator.

37. The method of claim 35, wherein the direction set switch is affixable to a member for allowing an operator of the transmitter to simultaneously toggle the direction set switch and perform a plurality of operations requiring the operator's hands.

38. The method of claim 34 further comprising the step of receiving a signal from the transmitter.

39. The method of claim 34, wherein the sensing compensates for the tilt of the direction sensor.

40. A trolling motor control system for controlling a trolling motor and for changing a target heading direction of a boat to which the trolling motor may be connected and directing the boat in the target heading direction, the trolling motor system comprising:

a direction sensor for sensing the target heading direction;

a digital compass; and a tilt compensator operatively connected to the digital compass for compensating for the orientation of the digital compass.

41. The trolling motor control system of claim 40, wherein the tilt compensator comprises an electronic circuit.

42. The trolling motor control system of claim 40, wherein the tilt compensator comprises a microprocessor.

43. The trolling motor control system of claim 40, wherein the tilt compensator comprises at least one of an electronic tilt sensor, a solid state magnetic sensor, and a fluid sensor.

44. The trolling motor control system of claim 40, wherein the digital compass comprises an electronic magnetic compass.

45. A motor control system for a trolling motor, comprising:

a heading detector indicating a heading, and comprising a tilt compensator operatively connected to a digital compass, wherein the tilt compensator adjusts an output from the digital compass to account for a roll angle and a pitch angle of the digital compass, a feedback analyzer operatively connected to the heading detector, wherein the heading detector provides a feedback signal to the feedback analyzer;

a propulsion device coupled to the heading detector;

a controller operatively connected to the feedback analyzer and to the propulsion device for controlling the heading, wherein the feedback analyzer achieves a heading substantially identical to a target heading, wherein the feedback analyzer provides a control signal to the controller.

46. The motor control system of claim 45, further comprising:

an input device operatively connected to the feedback analyzer, for receiving the target heading, wherein the input device transmits the target heading as a target heading signal.

47. The motor control system of claim 46, wherein the input device comprises a second heading detector.

48. The motor control system of claim 47, wherein the second heading detector comprises a second tilt compensator operatively connected to a second digital compass for adjusting an output from the second digital compass to account for a second roll angle and a second pitch angle of the second digital compass.

49. The motor control system of claim 48, wherein the input device comprises a toggle switch and the second heading detector for acquiring the target heading.

50. The motor control system of claim 48, wherein the second heading detector is mounted on at least one of a hat, a fishing pole and a pair of glasses.

51. The motor control system of claim 46, wherein the input device comprises a foot pedal having a variable angular position, the angular position being selectable, and the target heading signal being responsive to the angular position.

52. The trolling motor control system of claim 51, wherein the target heading signal is indicative of the angular position.

53. The motor control system of claim 46, wherein the input device comprises a hand lever.

54. A motor control system for a trolling motor, comprising:

a propulsion device coupled to a boat;

a steering actuator operatively coupled to the propulsion device, wherein the steering actuator is configured to control the orientation of the propulsion device in response to a steering control signal;

an input device for generating a waypoint signal, wherein the waypoint signal is representative of the position of an at least one waypoint;

a position detector for generating a position signal representative of the actual position of the boat;

a heading detector comprising a tilt compensator and a digital compass for generating a heading signal related to the actual heading of the boat, wherein the tilt compensator adjusts the output of the digital compass to account for a roll angle and a pitch angle of the digital compass; and a control circuit operatively connected to the input device, the position detector, the steering actuator and the heading detector, the control circuit being configured to determine the position of the at least one waypoint based upon the waypoint signal generated by the input device and to determine the actual position of the boat based upon the position signal generated by the position detector, the control circuit being further configured to determine a desired heading based upon the at least one waypoint and the actual position of the boat, and to generate the steering control signal to steer the boat toward the desired waypoint based upon the desired heading and the heading signal, wherein the control circuit steers the boat toward the at least one waypoint.

55. The motor control system of claim 54, wherein the control circuit is further configured to determine the at least one waypoint based upon the actual position of the boat when the input device is manipulated.

56. The motor control system of claim 55, wherein the input device comprises a switch.

57. The motor control system of claim 55, wherein the waypoint signal is representative of the longitude and latitude of the at least one waypoint.

58. The motor control system of claim 54, wherein the control circuit comprises a memory for storing the at least one waypoint.

59. The motor control system of claim 54, wherein the position detector receives a second position signal from at least one transmitting device.

60. The motor control system of claim 59, wherein the transmitting device comprises at least two satellites.

61. The motor control system of claim 60, wherein the position detector comprises a global position system receiver.

62. The motor control system of claim 61, wherein the position detector comprises a differential global position system receiver.

63. The motor control system of claim 54, wherein the steering actuator comprises a steering motor.

64. The motor control system of claim 54, wherein the heading signal is related to the direction of thrust produced by the propulsion device.

65. The motor control system of claim 54, wherein the heading signal is related to the orientation of the boat.

66. The motor control system of claim 54, wherein the heading detector comprises a circuit for determining the actual heading of the boat based upon a change in the actual position.

67. The motor control system of claim 54, wherein the magnitude of the thrust produced by the propulsion device is variable in response to a thrust control signal, and the control circuit is operatively connected to the propulsion device and is further configured to generate the thrust control signal.

68. The motor control system of claim 54, further comprising:

a housing operatively connected to the propulsion device, wherein the position detector, the steering actuator and the control circuit are located within the housing.

69. The trolling motor control system of claim 68, wherein the input device is mounted on a surface of the housing.

70. The motor control system of claim 54, further comprising:

a housing operatively connected to the propulsion device wherein the position detector is external to the housing.

71. The motor control system of claim 54, wherein the control circuit is configured to steer the boat in a predetermined pattern between a plurality of the at least one waypoints.

72. The motor control system of claim 54, wherein the control circuit is configured to steer the boat in a predetermined pattern when the boat arrives at the at least one waypoint.

73. The motor control system of claim 54, wherein, when the boat deviates from a desired course between a plurality of the at least one waypoints, the control circuit is configured to steer the boat substantially back to the desired course before resuming steering to the next waypoint.

74. The motor control system of claim 54, further comprising:

a mode select device operatively connected to the control circuit, wherein the control circuit is further configured to generate a steering control signal to steer the boat along a navigation route and to repeat the navigation of the boat around the navigation route in at least one mode of operation based upon a signal from the mode select device.

75. The motor control system of claim 74, wherein, in one mode of operation, the control circuit generates the steering control signal to steer the boat in reverse order along the navigation route after the boat arrives at an end of the navigation route, whereby the navigation route is repeated in reverse order.

76. The motor control system of claim 74, wherein, in one mode of operation, the control circuit generates the steering control signal to steer the boat in a continuous loop around the navigation route, whereby the navigation route is repeated in the same order.

77. The motor control system of claim 58, further comprising:

an automatic waypoint storage switch operatively connected to the control circuit, wherein the control circuit is further configured to store the at least one waypoint in the memory without operator intervention when the automatic waypoint storage switch is enabled, and to generate a steering signal to steer the boat along a navigation route.

78. The motor control system of claim 77, wherein the memory stores waypoints when a turn is detected when the automatic waypoint storage switch is enabled.

79. The motor control system of claim 77, wherein the memory stores a plurality of the at least one waypoints when the automatic waypoint storage switch is enabled.

80. The motor control system of claim 77, wherein the memory stores a plurality of the at least one waypoints at variable time intervals when the automatic waypoint storage switch is enabled, wherein the time intervals depend on the rate of change in the heading signal.

81. The motor control system of claim 77, wherein the memory stores waypoints at predetermined distance intervals when the automatic waypoint storage switch is enabled.

82. A motor control system for a trolling motor, comprising:

a propulsion device operatively connected to a boat, wherein the propulsion device produces a variable magnitude of thrust to propel the boat in response to a thrust control signal;

an input device for allowing an operator to provide a desired waypoint, wherein the desired waypoint is representative of a location the operator desires to travel to;

a position detector for generating a position signal representative of the actual position of the boat;

a steering actuator operatively connected to the propulsion device, wherein the steering actuator is configured to control the orientation of the propulsion device in response to a steering control signal;

a heading detector operatively connected to a tilt compensator and a digital compass for generating a heading signal related to the actual heading of the boat, wherein the tilt compensator adjusts the output of the digital compass to account for a roll angle and a pitch angle of the digital compass; and a control circuit operatively connected to the position detector, the propulsion device, the steering actuator, the heading detector, and the input device, the control circuit being configured to determine the actual position of the boat based upon the position signal generated by the position detector and to determine a desired heading based upon the desired waypoint and the actual position of the boat, the control circuit being further configured to generate a thrust control signal and the steering control signal to navigate the boat to the desired waypoint, wherein the control circuit generates the thrust control signal based at least upon signals generated by the input device.

83. The motor control system of claim 82, wherein the control circuit generates the steering control signal and the thrust control signals to maintain the boat substantially near the desired waypoint when the boat arrives substantially at the desired waypoint.

84. The motor control system of claim 82, wherein the input device generates signals representative of a desired magnitude of thrust.

85. The motor control system of claim 82, wherein the input device generates signals representative of a desired speed of the boat, and the control circuit generates the thrust control signal based upon the desired speed and an actual speed of the boat.

86. The motor control system of claim 85, wherein the actual speed of the boat is an absolute speed based upon a derivative of at least two successive position signals.

87. The motor control system of claim 85, further comprising:

a sensor operatively connected to the control circuit for sensing the speed of the boat relative to a body of water, wherein the actual speed of the boat is the speed relative to the body of water.

88. The motor control system of claim 82, wherein the control circuit modifies the thrust control signal based upon a predetermined relationship between the actual position of the boat and the desired waypoint.

89. The motor control system of claim 82, wherein the control circuit modifies the thrust control signal to gradually decrease the speed of the boat as the fishing boat nears the desired waypoint.

90. The motor control system of claim 82, wherein the control circuit modifies the thrust control signal based upon the rate at which the boat is turning.

91. The motor control system of claim 82, wherein the control circuit generates the thrust control signal to turn off the propulsion device when the fishing boat arrives substantially at the desired waypoint.

* * * * *